United States Patent [19]

Burkart

[11] 4,018,454

[45] Apr. 19, 1977

[54] DEVICE FOR DAMPING VIBRATION OF A SKI

[75] Inventor: Oskar Burkart, Forst, Baden, Germany

[73] Assignee: Hannes Marker, Garmisch-Partenkirchen, Germany

[22] Filed: Feb. 23, 1976

[21] Appl. No.: 660,185

Related U.S. Application Data

[62] Division of Ser. No. 513,150, Oct. 8, 1974, abandoned.

[30] Foreign Application Priority Data

Oct. 9, 1973 Germany ..... 2350656

[52] U.S. Cl. ..... 280/602

[51] Int. Cl.[2] ..... A63C 5/07

[58] Field of Search ..... 280/602, 601

[56] References Cited

UNITED STATES PATENTS

| | | | |
|---|---|---|---|
| 2,918,293 | 12/1959 | Tavi | 280/602 |
| 3,776,563 | 12/1973 | Tigert | 280/602 |

FOREIGN PATENTS OR APPLICATIONS

| | | | |
|---|---|---|---|
| 1,428,966 | 1/1969 | Germany | 280/11.13 F |
| 1,922,960 | 11/1970 | Germany | 280/602 |
| 1,478,110 | 9/1969 | Germany | 280/602 |
| 30,008 | 2/1919 | Norway | 280/602 |

*Primary Examiner*—Joseph F. Peters, Jr.
*Assistant Examiner*—David M. Mitchell
*Attorney, Agent, or Firm*—Fleit & Jacobson

[57] ABSTRACT

A vibratory system having one or more resonant frequencies between 1 Hz and 40 Hz is provided on the ski and exerts forces on the ski to oppose the excursions of the latter.

2 Claims, 4 Drawing Figures

DEVICE FOR DAMPING VIBRATION OF A SKI

Figure 1:
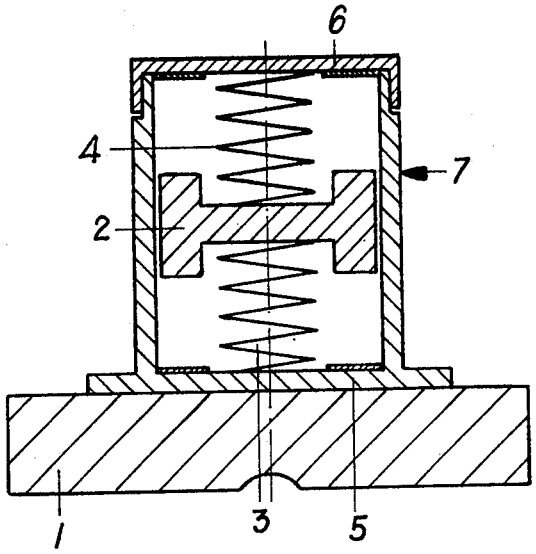

This is a division of application Ser. No. 513,150 filed Oct. 8, 1974 now abandoned.

This invention relates to a device for damping vibration of a ski.

The skis which are presently available exhibit an unsatisfactory performance under difficult snow conditions, particularly on hard or even iced snow. When a ski is moving on a hard surface, the surface irregularities which are present on any slope excite a vibration in the ski at closely succeeding times. This most disturbing phenomenon affects mainly the forward end of the ski. As a result, the contact of the ski with the slope is continually interrupted in an undesired manner.

This effect adversely affects the directional stability. Particularly when traversing a slope, the ski will slip laterally as soon as its vibration causes the edge of the ski to set out of contact with the slope. The skier cannot prevent these unwanted movements of the ski but can at best correct their effects.

These phenomena render skiing difficult or even dangerous, particularly for skiers which are not highly trained. Another highly unfavorable result resides in that the vibration of the ski is transmitted to the skier, particularly to his or her leg muscles. This is physically annoying and results in a premature fatique of the skier.

It has already been proposed to damp vibration of a ski by designing it for a high elasticity so that the ski is so flexible that it can slide over surface irregularities of the slope with a minimum of resistance and yet can maintain contact with the slope so as to ensure a satisfactory directional stability.

For instance, the Opened German Specification 1,960,408 discloses several embodiments of a device which serves to damp vibrations of a ski and substantially consists of at least one closed cavity, which is provided in or on the ski and which contains liquid and/or solid media, which can move relative to each other and/or in themselves to produce the friction which is required for damping.

For certain reasons, a frictional damping cannot produce the results which are desired during skiing, so that the proposed embodiments have not been adopted in practice.

The present invention is based on an entirely different concept and proposes a device which serves to damp vibrations of a ski and comprises a vibratory system which is provided on the ski and exerts forces on the ski to oppose the excursions of the latter and has one or more resonant frequencies between 1 Hz and 40 Hz. As a result, any vibration of the ski is extinguished within very short time by interference so that the contact of the ski with the slope can be optimally maintained and an optimum directional stability and control can be ensured.

According to a preferred structural feature of the invention the vibratory system comprises a mass which is resiliently mounted so as to be movable substantially at right angles to the tread of the ski.

According to another preferred feature, the mass is held between two springs acting in the direction of movement. The springs consist suitably of helical compression springs.

In another embodiment, the mass consists of a rocker arm, which in position of rest extends at least approximately parallel to the ski and is biased by a tension spring, and the pivotal axis of the rocker arm is preferably provided adjacent to the upturned forward portion of the ski.

These embodiments of the device according to the invention are particularly intended to be subsequently mounted on existing skis.

According to a further preferred feature of the invention, the mass of the vibratory system may constitute the tip portion of the ski and the hinged to the remaining part of the ski. An elastic bonding material, such as rubber, is preferably used to resiliently hold the tip portion of the ski.

To reliably prevent an unintended separation between the tip portion and the remaining part of the ski, the hinge may be spaced from the elastic bonding material and have an axis which is parallel to the tread of the ski and transversely to the longitudinal direction of the ski.

Figure 2:
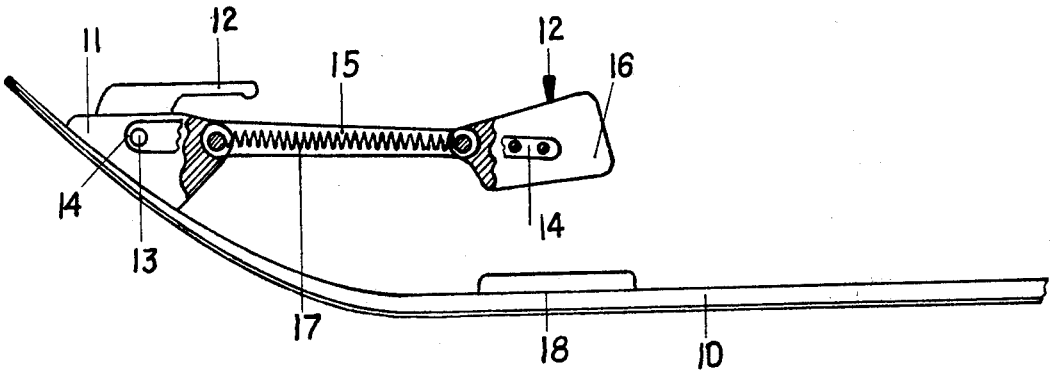

Embodiments of the device according to the invention will be fully described hereinafter by way of example and with reference to the accompanying drawings, in which FIG. 1 is a central transverse sectional view showing a first embodiment of a device for damping vibration of a ski, FIG. 2 is a side elevation partly cut open to facilitate the understanding and showing the second embodiment of the device according to the invention.

Figure 3:
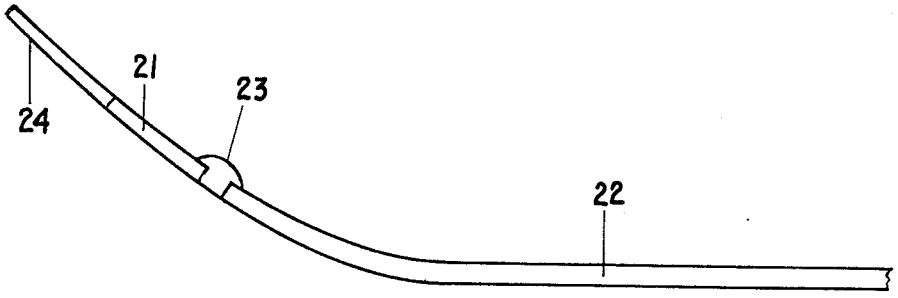
Figure 4:
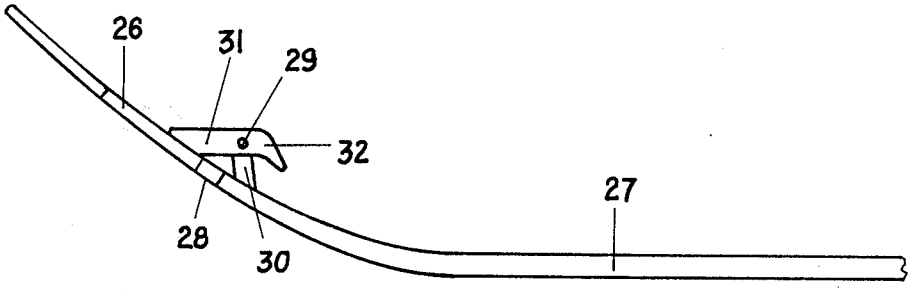

FIGS. 3 and 4 show two further embodiments of damping devices which are integrated into a ski.

According to the present invention, vibration of a ski is damped by a special vibratory system which has a resonant frequency and exerts forces on the ski which oppose the excursions of the latter.

The resonant frequency of the device according to the invention lies between 1 and 40 Hz because the frequency of vibration of skis varies within a large range in dependence on the structure, length and other properties of the skis.

In the embodiment shown in FIG. 1 the vibratory system consists of a mass 2, which is movable at right angles to the tread of the ski 1 and which is held between springs 3 and 4. The springs bear respectively on the top wall 6 and bottom wall 5 of a housing 7, which is secured to the ski in any desired manner. The housing may be detachably or permanently secured to the ski, in accordance with the desires and requirements in each case.

Whereas the housing 7 need not be closed to be able to hold the vibratory system, the housing is entirely closed to prevent an interference with the function of the vibratory system by external influences, such as snow, water, dirt etc.

To ensure an optimum performance of the device with a minimum expenditure of material, the device is mounted on the ski as close as possible to the tip of the ski.

An additional device according to the invention can obviously be provided on the rear half of the ski so that vibration of said half will also be damped.

The second embodiment of a device according to the invention for damping vibration of a ski is shown in FIG. 2 and provided directly at the tip of a ski 10. A bracket 11 is secured in any desired suitable manner to the upturned front portion of the ski. The mass of the vibratory system consists of a normally horizontally extending rocker arm 12, which is pivoted by a pin 13 to the bracket 11.

The rocker arm 12 consists of two rods 14, 15, which are interconnected at one end by a crosspiece 16. The other end portion of each rod is disposed on the outside of the bracket 11 and mounted on the pin 13. A tension spring 17 is provided between the two rods 14, 15. One end of the spring 17 is secured to the crosspiece 16 and the other end to the bracket 11. This tension spring tends to hold the rocker arm in a normal position, in which the arm is spaced from the surface of the ski. In this embodiment the mass of the vibratory system is also movable substantially at right angles to the tread of the ski.

The normally occurring excursions of vibrating ski end portions are such that it will be sufficient to provide the vibratory system according to the invention with a mass which is free to vibrate with an amplitude of about 40 millimeters. In order to prevent a hard engagement of the rocker arm as a result of an exceptional larger excursion of the vibrating ski, elastic stops 18 and 19 are provided to limit the movement of the arm to both sides.

FIG. 3 shows a device which serves to damp vibration of a ski and in which the mass of the vibratory system provided according to the invention constitutes a tip portion 21 of the ski and is connected to the remaining part 22 of the ski by a hinge 23, which consists, e.g., of rubber. This elastic hinge permits of a reciprocating movement of the tip portion of the ski approximately at right angles to the thread of the ski. To provide a sufficiently large mass for the vibratory system, the free end portion 24 of the tip portion of the ski may preferably be made from a material having a high specific gravity.

FIG. 4 shows an embodiment which is slightly modified from that of FIG. 3. In the embodiment of FIG. 4, an unintended separation between the tip portion 26 of the ski and the remaining part 27 of the ski is prevented in that the tip portion and the remaining part of the ski are connected by an elastic joint 28 and by a hinge having a hingepin 29, which is spaced from the elastic joint and extends parallel to the tread of the ski and transversely to the longitudinal direction of the ski. The hingepin 29 is mounted in two congruent brackets 30, which are provided on the ski, and by means of two arms 31, which are also congruent, carries the tip portion 26 of the ski. The arms 31 extend beyond the hingepin 29 and form stop noses 32 for limiting the upward movement of the tip portion of the ski.

The provision of the devices according to the invention for damping vibration of a ski opens up now possibilities for the manufacture of skis. The expensive methods previously adopted to provide for at least a small self-damping property of a ski may be abandoned so that the ski may be manufactured by simpler and less expensive methods. In the design of skis, full consideration can now be given to the requirement for a high strength and high elasticity.

In dependence on the requirements in each case, it is also within the scope of the invention to provide a vibratory system which comprises a plurality of spring-mass systems having different resonant frequencies.

What is claimed is:

1. A device for damping vibration of a ski comprising, in combination, a tip portion of the ski formed separately from the remaining part of the ski, hinge means including an elastic joint of elastomeric bonding material for connecting said tip portion to the remaining part of the ski to permit independent, resilient movement of said tip portion at substantially a right angle to the tread of the ski, said tip portion comprising a mass having a reasonant frequency of between 1Hz and 40Hz so as to form a vibratory system for exerting forces on the ski.

2. A device in accordance with claim 1 wherein said hinge means include a hinge connected at opposite ends to said tip portion and the remaining part of the ski respectively, said hinge including a hinge pin disposed intermediate the opposite ends of said hinge in spaced relationship with said joint and extending parallel to the tread of the ski and transversely to the longitudinal direction of the ski.

* * * * *